US006065598A

United States Patent [19]

Anderson

[11] Patent Number: 6,065,598

[45] **Date of Patent: *May 23, 2000**

[54] MULTIPLE BIT HOLDING ACCESSORY FOR HAND TOOL AND METHOD OF MANUFACTURING SAME

[76] Inventor: Wayne Anderson, 65 Grove St., Northport, N.Y. 11768

[ * ] Notice: This patent is subject to a terminal disclaimer.

[21] Appl. No.: 09/252,277

[22] Filed: Feb. 18, 1999

Related U.S. Application Data

[63] Continuation of application No. 08/807,555, Feb. 28, 1997, Pat. No. 5,992,626

[60] Provisional application No. 60/012,572, Feb. 29, 1996.

[51] Int. Cl.[7] ..... B65D 85/28

[52] U.S. Cl. ..... 206/378; 211/70.6; 81/177.4; 81/490

[58] Field of Search ..... 81/177.4, 490, 81/DIG. 5; 206/376–378, 493; 211/70.6

[56] References Cited

U.S. PATENT DOCUMENTS

| | | | |
|---|---|---|---|
| 4,716,796 | 1/1988 | Corona et al. | 81/177.4 |
| 5,535,882 | 7/1996 | Liu | 206/377 |
| 5,566,596 | 10/1996 | Lin | 81/490 |

*Primary Examiner*—James G. Smith
*Attorney, Agent, or Firm*—Lackenbach Siegel

[57] ABSTRACT

A tool/accessory caddy for removably holding a plurality of tools or portions thereof, such as driver bits and nut drivers. The tool/accessory housing has a plurality of apertures, and is made of a material of sufficient elasticity for enabling driver bits or nut drivers to be securely retained in place in said apertures, and the tool/accessory housing has an apertured portion for the resilient gripping of the tool/accessory housing to a portion of a tool.

8 Claims, 2 Drawing Sheets

MULTIPLE BIT HOLDING ACCESSORY FOR HAND TOOL AND METHOD OF MANUFACTURING SAME

PRIOR RELATED APPLICATIONS

This application is a continuation of U.S. Ser. No. 08/807,555, filed Feb. 28, 1997, now U.S. Pat. No. 5,992,626, and related to provisional application U.S. Serial No. 60/012,572, filed Feb. 29, 1996.

BACKGROUND OF THE INVENTION

This invention relates to accessories for hand tools and methods of manufacturing same; and, more particularly, it relates to an accessory for hand tools that removably stores multiple bits and that removable mounts onto a portion of a hand tool or storage rack for tools and portions thereof and methods for manufacturing same.

Many current vinyl type hand tool storage devices are manufactured by dipping a series of hot pins into room temperature vinyl material. There are a few devices that are molded in an enclosed mold. These devices are not made by pulling the cores in the plane 90° degrees from the dip direction. This means that these devices have the drawback that they cannot be attached or connected to another tool or tool holder unless the tool or tool holder unto which the device is connected points in the same direction as the bits in the holder. The devices also have the draw back that if tools of a different size and shape are attached to these devices, the resulting combination tool holder/tool/device would have an aesthetically unpleasing look and/or would be difficult to store in a tool box.

Socket rails that are used to store sockets are sold in the hundreds of thousands of units annually. However, the trend is to use more screws in new cars and other products than bolts and the like. There is a need for a device to add value and features to today's socket rails and other tools and to satisfy the need to have various types of driver bits available for the repair and maintenance of an automobile and other products. There is a need for a low cost vinyl bit and/or tool holding block that attaches or connects directly by a friction fit or other means of connection in a manner that provides ease of access to a wide variety of tool bits and the like.

It is an object of the present invention to meet the needs of the market and solve the problems in the market place associated with currently existing devices.

SUMMARY OF THE INVENTION

The invention provides a novel tool accessory caddy and method of manufacturing a low cost, highly versatile tool accessory caddy. The objects and features of the present invention, other than those specifically set forth above, will become apparent in the detailed description of the invention set forth below.

DETAILED DESCRIPTION OF THE INVENTION

Figure 1:
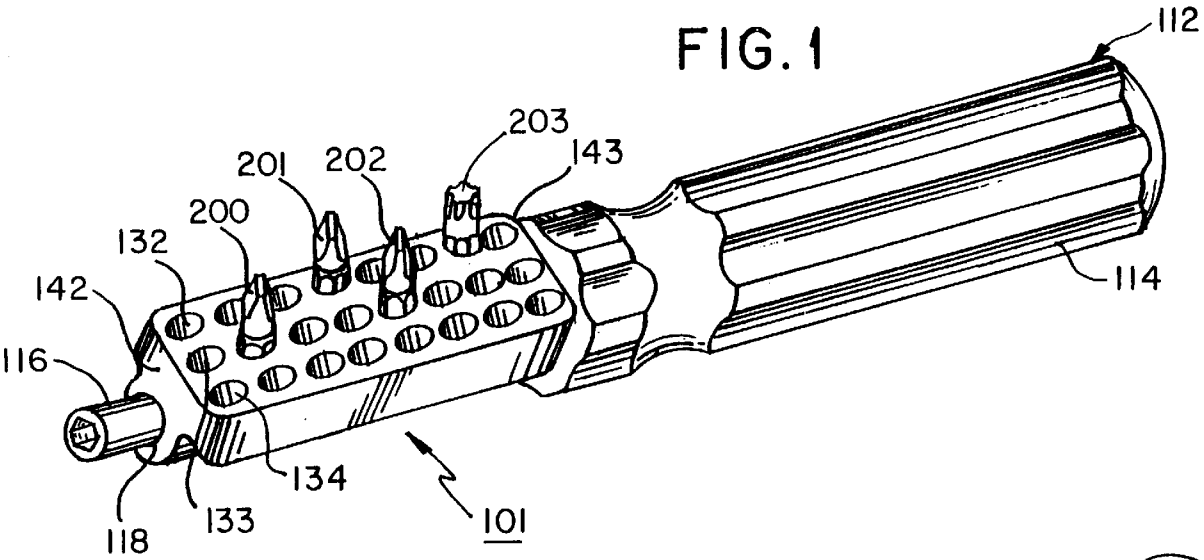
FIG. 1 is a perspective view of a multiple bit storing accessory mounted onto a shank of a nut driving or a screw driving hand tool.
Figure 2:
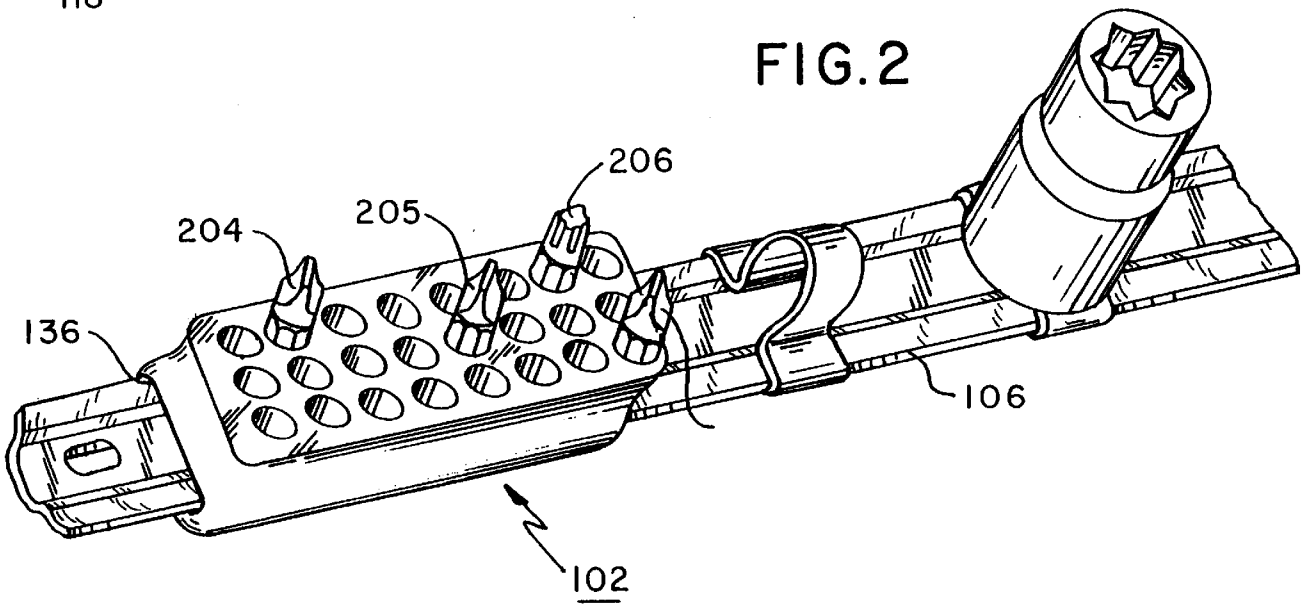
FIG. 2 is a perspective view of a multiple bit storing accessory connected to a socket rail.
Figure 4:
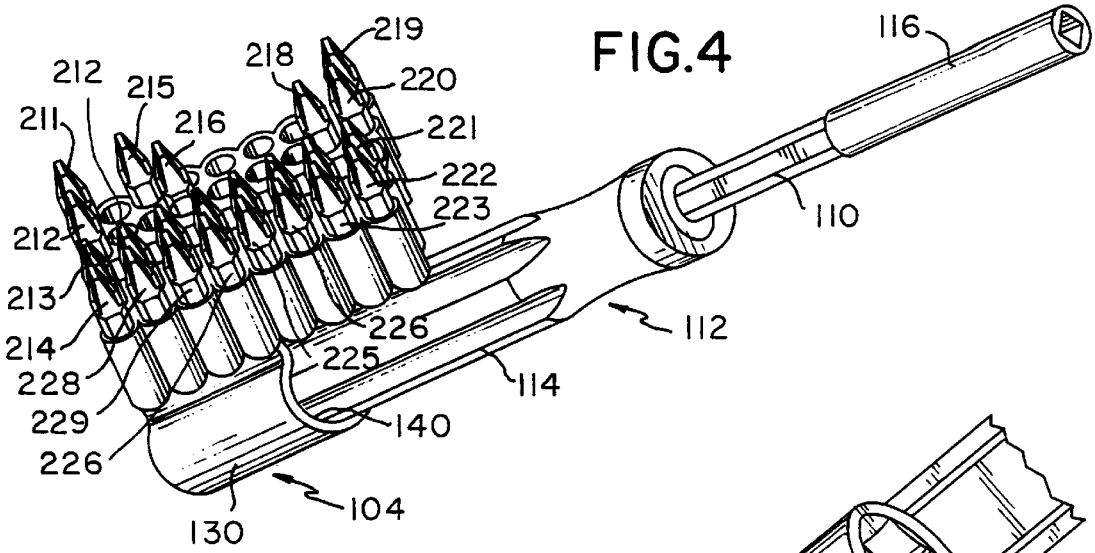
Figure 3:
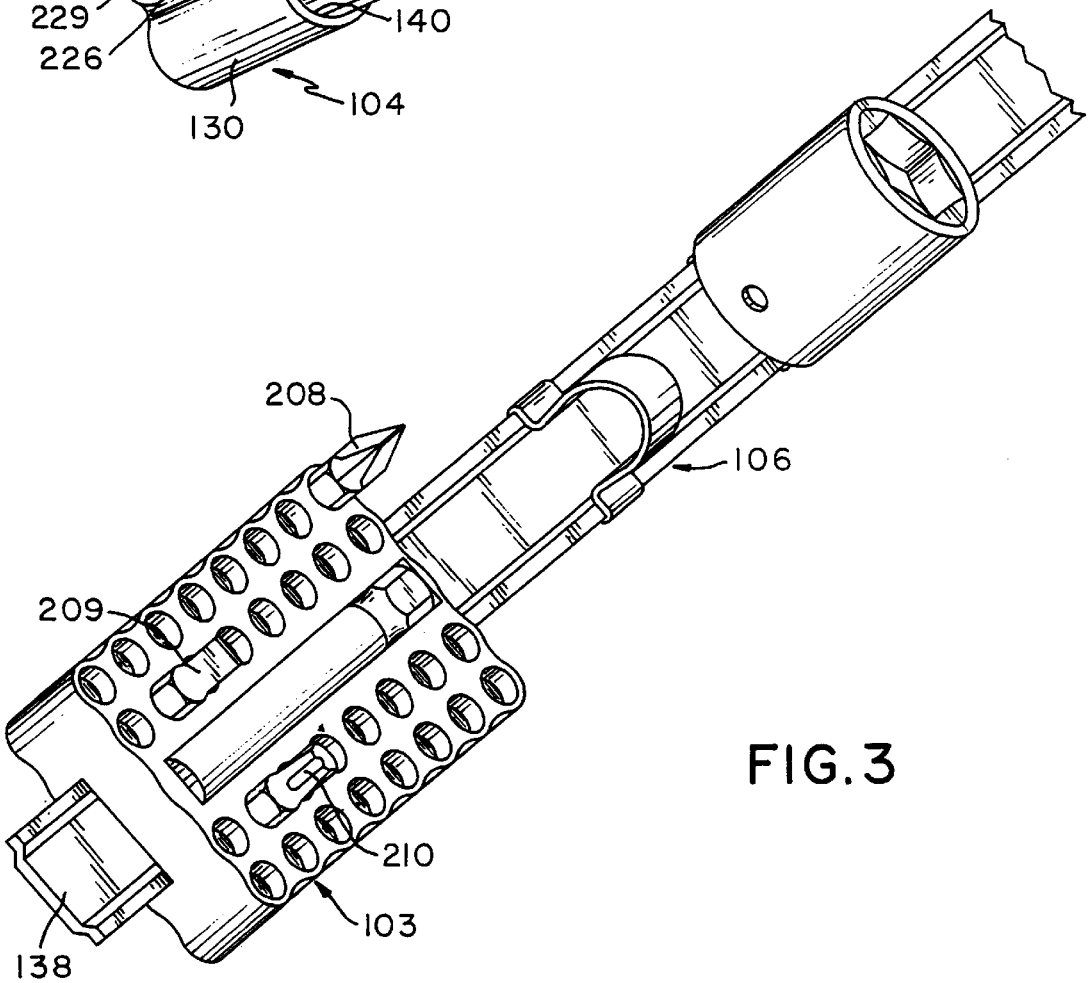
FIG. 3 is a perspective view of a variant of the multiple bit storing accessory connected to a socket rail; and, FIG. 4 is a perspective view of a multiple bit storing accessory mounted onto a base or handle of a nut driving or screw driving hand tool.

The dip molded multi-bit storing accessories 101–104 (FIGS. 1–4) are dip molded. They are manufactured by dipping a series of hot pins into room temperature vinyl material. The dip molded multi-bit storing accessory is manufactured by a method that comprises the step of adding a retaining sleeve of a cap that is at 90° to the dip mold plane. This is accomplished by the injection process and by the step of pulling a pin/core in this 90° plane. The method steps and concept is revolutionary in its various applications for forming multi and single bit storing tool accessories.

Socket rail 106 (FIGS. 2–3) is used to store socket sets and generally comes in conventional sizes for ¼", ⅜" and ½" drives. Dip molded multi-bit storing accessory 101–104 is used to removably connect a multiplicity or plurality of driver bits 200–228 to screw driver shank 110 of screw driver 112. Screw driver 112 includes handle 114 and optional nut driver 116. In one variant accessory 101 is removably connected to screw driver 112 by slipping accessory aperture 118 onto shank 110 and nut driver portion 116. Aperture 110 is formed from vinyl and is generally of an elasticity and a size and shape to expand enough to slip onto shank 119 and nut driver portion 116 and then retain said accessory is a semi-permanent or fixed position once on shank 119 and nut driver portion 116. In a further variant, accessory 104 includes a mounting member 130 including a cavity or well portion of a size and shape to removably connect accessory 104 to handle 114. Again, the vinyl material accessory 104 is formed from has elastic properties to allow member 130 to mount onto handle 114 and remain mounted thereto by a friction fit.

Further accessories have an array of wells 132–134 (FIG. 1) that are of a size and shape to accommodate different driver bits. It is appreciated that wells 132–134 can be of different sizes and shapes to accommodate and retain other tools and tool portions other than driver bits by friction fit, e.g. socket wrenches. Other examples of the tools that can be stored on accessories 101–104 include cutting tools that are attached to a chucking device of a cutting tool. Other tools to which accessories 101–104 can be attached include larger tools that include power tools, and also tool storage devices.

It is appreciated that accessory retaining apertures 118, 136–140 are substantially perpendicular to wells 132–134, and extend from distal end 142 to proximal end 143 of accessories 101–104.

The vinyl material from which accessories 101–104 are formed can have various colored pigments added thereto to form zones in which different style bits or other tools or portions thereof can be stored by colored zone. By way of example, a red zone that would include a a single or multiple rows or columns of wells 132–134 could store phillips bits, a blue zone, row or column designates a storage zone for slotted bits, a green storage zone, column, or row designates a storage area for torx® bits, etc. A neon color zone can be used for locating the accessory in a cluttered tool box. Further color coding of the accessories is useful to designate ownership of particular tools or accessories.

It is appreciated that accessories 101–104 can have a variety of designs other than those pictured in FIGS. 1–4. Further, there exists an infinite number of combinations of sizes and shapes for wells 132–134 that can be used with the tool and attached to a rail or other tool. For example, burring tools are connected to a burring tool handle (not pictured) with the accessories 101–104.

The tool accessory includes an array of cavities of a size and shape for retaining by friction fit a plurality of tools or portions thereof that include driver bits, and mounting aperture of a size and shape for removably or permanently mounting said accessory onto a tool or portion thereof or onto a tool retention device. The mounting aperture is substantially perpendicular to the cavities of the array. The accessory is generally formed from a single unitary piece of inexpensive vinyl material. It is appreciated that the tool accessory or caddy of the present invention has exemplary benefits or features that include low cost of manufacture.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

What is claimed is:

1. In combination with a rigid and elongated socket rail adapted for holding one or more socket drives:

the combination comprising a plurality of bit drives and a caddy for storing and holding said plurality of bit drives having a housing formed of resilient material, said housing being formed with a plurality of compartments for holding an end portion of each bit drive of said plurality of bit drives; said housing being further formed with an elongated opening for engaging a portion of the socket rail, wherein said elongated opening is orthogonal to said plurality of compartments, said resilient material being sufficiently resilient to resiliently grip and hold said plurality of bit drives in place in said compartments and for grippingly engaging said socket rail portion, whereby sail plurality of bit drives are visually identifiable and accessible for use.

2. The combination of claim 1, wherein said plurality of compartments are blind apertures.

3. The combination of claim 2, wherein said blind apertures are all round parallel holes.

4. The combination of claim 1, further including at least one elongated compartment for storing a bit drive holder.

5. The combination of claim 1, wherein said caddy is provided with delineated zones for different style bit drives.

6. The combination of claim 5, wherein said zones are color coded for each different style of bit drives.

7. The combination of claim 1, wherein said caddy is neon colored for ease of location.

8. The combination of claim 1, wherein said plurality of compartments are of different sizes and shapes to accommodate and retain various tools or tool portions in addition to or other than bit drives.

* * * * *